United States Patent [19]

Sheets

[11] 3,964,688

[45] June 22, 1976

[54] LAWN, FARM, AND ORCHARD SPRINKLERS

[76] Inventor: Kerney T. Sheets, P.O. Box 637, Duplessis, La. 70806

[22] Filed: Aug. 11, 1975

[21] Appl. No.: 603,495

Related U.S. Application Data

[62] Division of Ser. No. 439,323, Feb. 4, 1974, abandoned.

[52] U.S. Cl. ..... 239/226; 239/318; 239/516

[51] Int. Cl.[2] ..... B05B 3/02

[58] Field of Search ..... 239/226, 310, 317, 318, 239/516

[56] References Cited

UNITED STATES PATENTS

| | | | |
|---|---|---|---|
| 2,573,687 | 11/1951 | Brock | 239/226 |
| 2,580,629 | 1/1952 | Wenzel | 239/226 X |
| 2,599,678 | 6/1952 | Walker | 239/310 |
| 2,622,928 | 12/1952 | Misch | 239/226 |
| 2,979,271 | 4/1961 | Boyden | 239/226 X |
| 3,134,546 | 5/1964 | Laughlin | 239/226 X |

*Primary Examiner*—John J. Love
*Attorney, Agent, or Firm*—David L. Ray

[57] ABSTRACT

Projectable sprinklers which rise automatically from the ground when water is supplied under pressure to the sprinklers, sprinkler heads, stationary sprinklers employing the sprinkler head of the present invention for use on the surface of the ground, and a lid apparatus for increasing the area wetted by a sprinkler head. The projectable sprinklers include a generally cylindrical housing closed at the bottom and sunken in the ground, a projectable float which floats upward within the housing when water is supplied under pressure to the sprinkler, and a sprinkler head including a rotating nozzle or nozzles attached to the top of the float. In one embodiment, the projectable sprinkler contains means for spreading chemicals over the surface of the ground. The sprinkler heads include means for pumping solutions or liquid mixtures of chemicals through the nozzle or nozzles of the sprinkler head, and may be used in a stationary or projectable sprinkler system. The stationary sprinklers include the sprinkler heads of the present invention and means for spreading chemicals over the surface wetted by the sprinkler. The lid apparatus includes a disc mounted on top of a sprinker head having a movable flap therein.

13 Claims, 16 Drawing Figures

LAWN, FARM, AND ORCHARD SPRINKLERS

This is a division of application Ser. No. 439,323, filed Feb. 4, 1974, now abandoned.

BACKGROUND OF THE INVENTION

The present invention relates to projectable sprinklers with a rotating nozzle or nozzles which are automatically projected or advanced to a position above the surrounding ground level when water is supplied under pressure to the sprinkler, to sprinkler heads which can be used on a projectable or non-projectable sprinkler, to stationary sprinklers for use on the surface of the ground, and to an apparatus for increasing the area wetted by a sprinkler.

The advantages of a projectable sprinkler include avoidance in a lawn, farm or orchard of a permanently raised fixture which can cause accidents, which is unsightly and around which the grass must be edged or clipped by hand, and avoidance of damage to a sprinkler system by children playing with a permanent, elevated standpipe, or by accidently hitting such a standpipe with a lawn mower, tractor, or car.

To realize such advantages many forms of projectable sprinklers have been proposed, both commercially and in the patent literature. U.S. Pat. Nos. 3,104,822; 2,611,644; 2,013,849 and my U.S. Pat. No. 3,709,435 disclose various types of projectable sprinklers.

One difficulty encountered in making a commercially successful projectable sprinkler has been the complexity and number of parts required. Most sprinklers are costly to manufacture, difficult to assemble, repair, and service, and are unreliable in operation. In addition, some prior art sprinklers have suffered from the inability to seal well, thus causing an unnecessarily large drop in pressure so that fewer projectable sprinklers than permanently raised sprinklers could be used on a supply line of a given hydraulic capacity.

An additional problem encountered in some prior art projectable lawn sprinklers is that to prevent the standpipe projected from the ground from rocking it was necessary to have the relatively movable parts fit one another quite closely and to have lengthy bearing surfaces, i.e., lands. On the other hand, when the parts fitted closely substantial friction developed and foreign matter tended to stick between the parts. This sometimes jammed the standpipe and at other times scored the parts so as to permit leakage to develop. Furthermore, the use of long lands required additional effort to raise the standpipe and made it more vulnerable to jamming.

Further disadvantages of some prior art projectable lawn sprinklers were that they did not tend to assume and maintain the same predetermined substantially vertical position each time they were erected, that they did not erect to great heights because clearances and friction were multiplied when the movement of the standpipe from retracted to extended position become appreciable, and that grass would frequently grow over the top of the projectable lawn sprinkler and prevent the sprinkler from rising.

Furthermore, some prior art lawn sprinklers could not be advanced or projected above the ground when the housing of the sprinkler was filled with water, and the area wetted by the sprinkler was undesirably small. Also, most, if not all prior art stationary and projectable sprinklers did not have means for applying a chemical, such as fertilizer or weed killer, to the sprinkled area.

THE INVENTION

The projectable sprinklers of the present invention include a projectable float having a sprinkler head attached to the top end thereof, a housing in which the projectable float moves, and a water supply attached to the sprinkler head. The sprinkler heads of the present invention include a rotating nozzle or nozzles for spraying water from the sprinkler head, and a pumping apparatus attached to the nozzle or nozzles for pumping solutions or liquid mixtures of chemical through the nozzle or nozzles. The stationary sprinklers of the present invention include the sprinkler head of the present invention combined with means for applying a compound or solution to the area wetted by the sprinkler. The apparatuses for increasing the wetted area around the sprinkler include a disc mounted on top of a sprinkler head having a movable flap therein.

The invention will be more fully understood by referring to the drawings in which.

Figure 1:
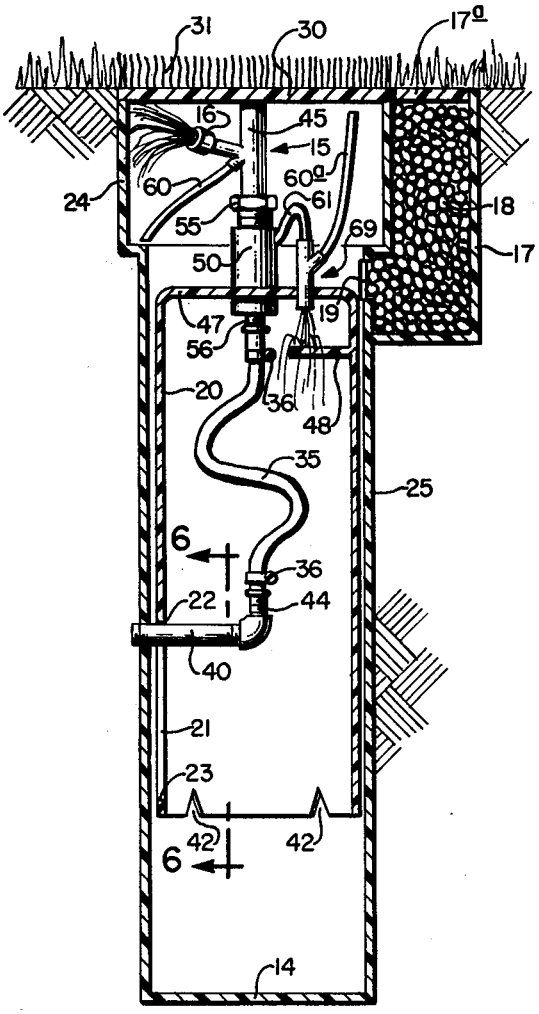
FIG. 1 is a partly sectional side view of a projectable sprinkler in a submerged position, the sprinkler having no liquids therein.
Figure 2:
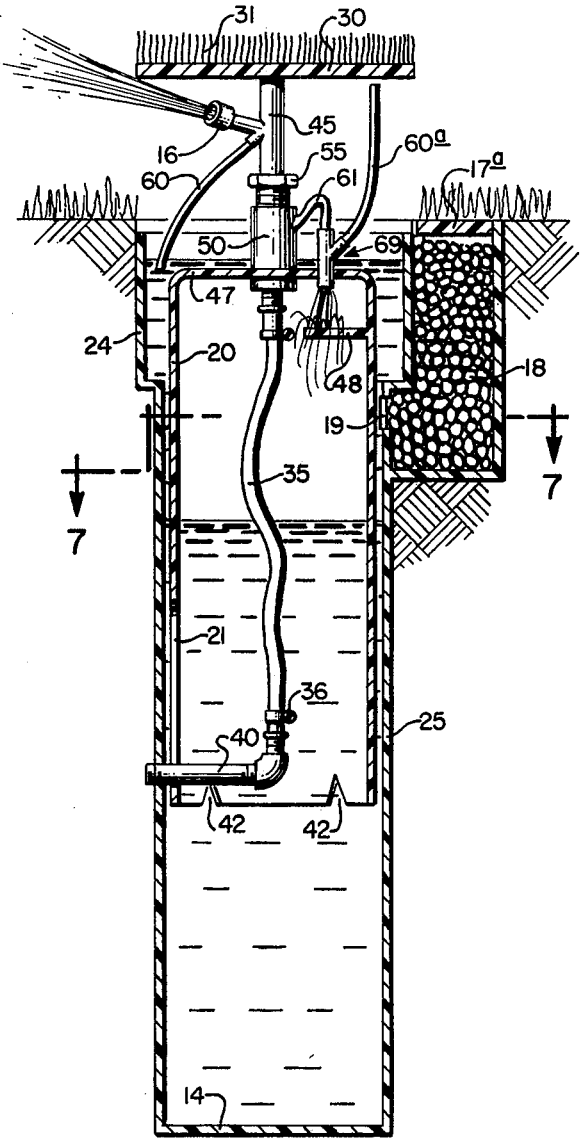
FIG. 2 is a partly sectional side view of a projectable sprinkler in the projected position.
Figure 4:
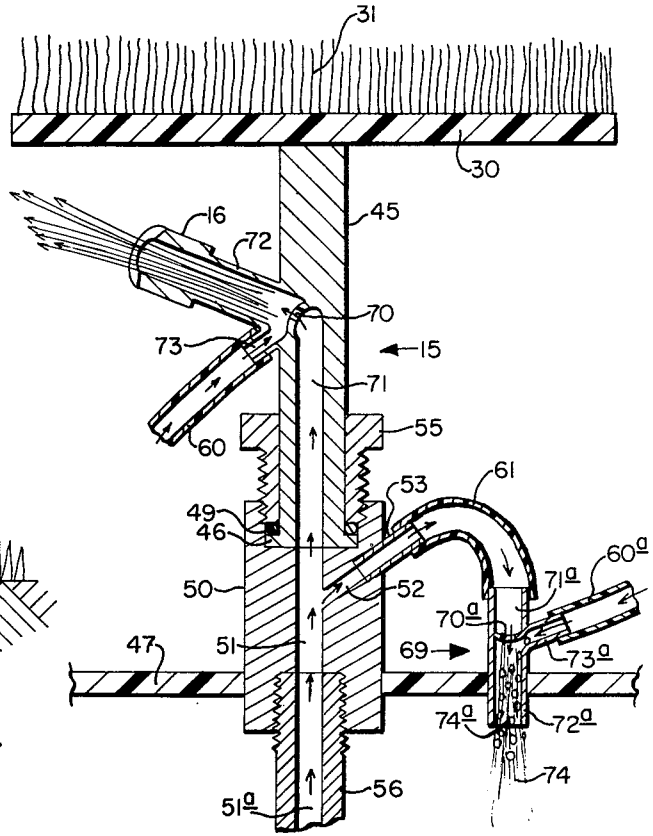
Figure 5A:
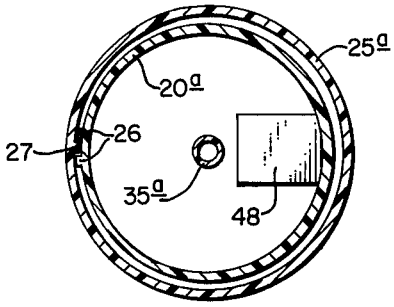
Figure 6:
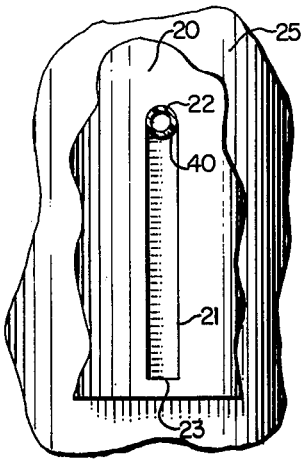
Figure 5:
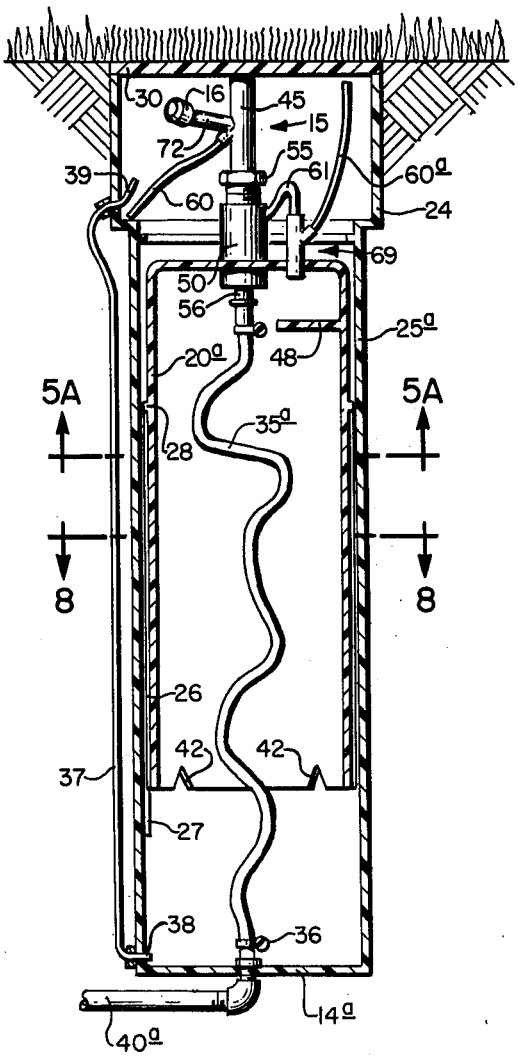
Figure 7:
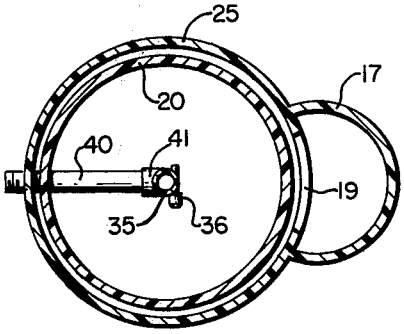
Figure 9:
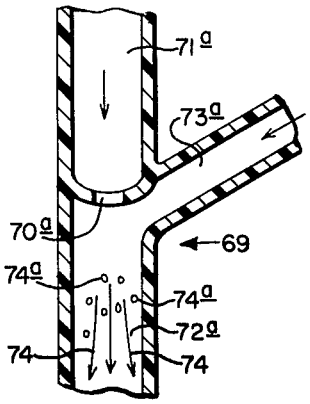
Figure 8:
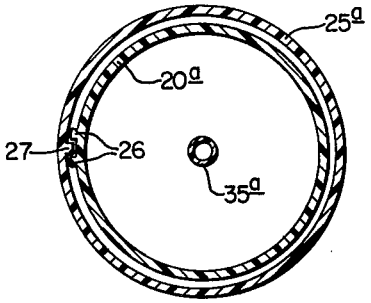
Figure 10:
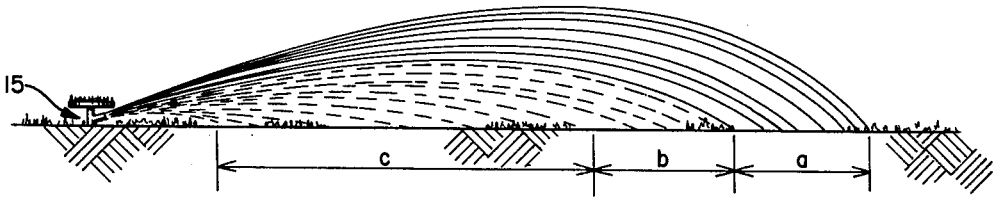
Figure 11:
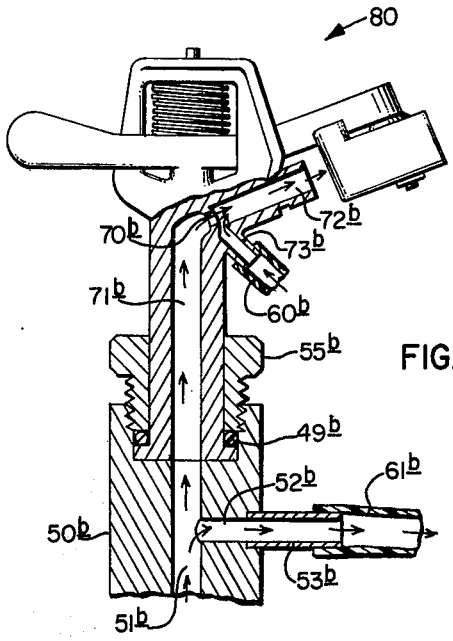
Figure 12:
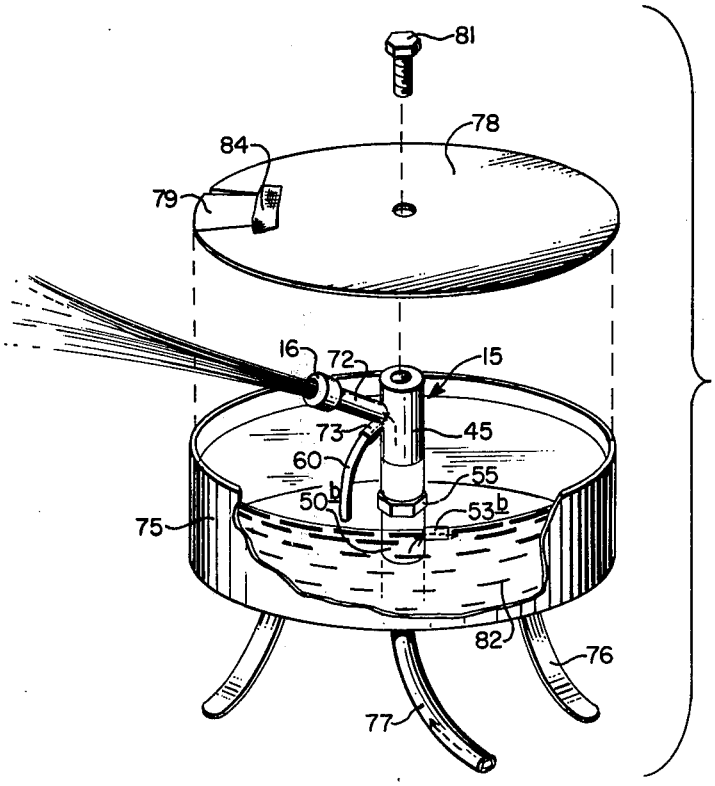
Figure 13:
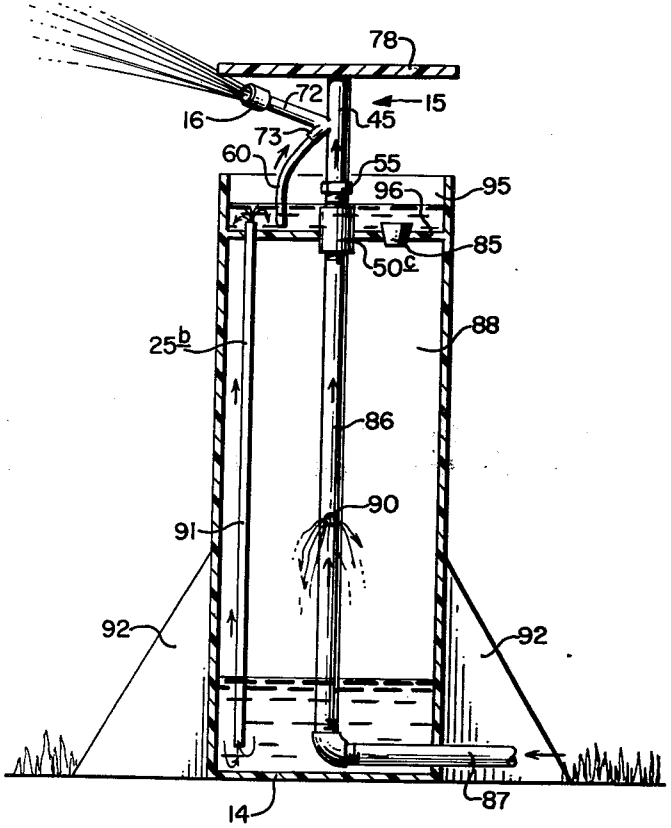

FIG. **3*a*** is a partly sectional side view showing the decrease of the water level in the float when the projectable sprinkler is started in a submerged position filled with water;

FIG. 4 is a partly sectional side view showing details of a rotating sprinkler head attached to the float;

FIG. 5 is a partly sectional side view of an alternate embodiment of a projectable sprinkler in a submerged position;

FIG. **5*a* is a partly sectional view taken along lines 5*a*—5*a* of FIG. 5**;

FIG. 6 is a partly sectional view taken along lines 6—6 of FIG. 1;

FIG. 7 is a partly sectional view taken along lines 7—7 of FIG. 2;

FIG. 8 is a partly sectional view taken along lines 8—8 of FIG. 5;

FIG. 9 is a detailed, sectional view of a structure for pumping air into the float;

FIG. 10 is a side view of a projected sprinkler spraying water upon an area of ground;

FIG. 11 is a partly sectional side view of a sprinkler head of the prior art modified in accordance with the present invention;

FIG. 12 is an exploded, partly sectional, perspective view of the sprinkler head of the present invention employed on a stationary sprinkler base;

FIG. 13 is a partly sectional side view of a stationary sprinkler; and

Figure 14:
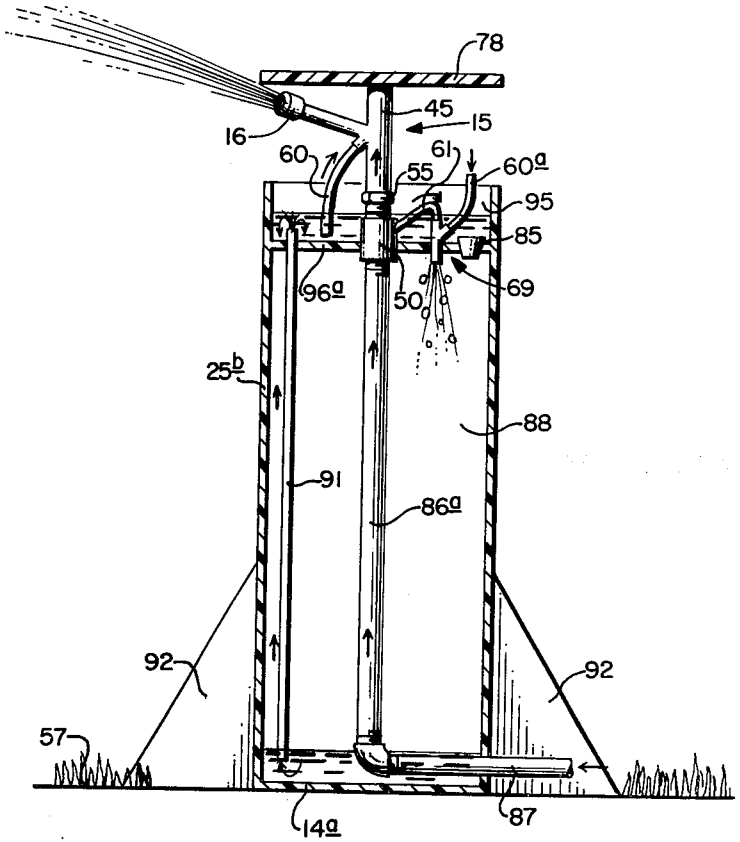

FIG. 14 is a partly sectional side view of another stationary sprinkler.

Referring now to the drawings, and in particular drawings 1–4, the projectable sprinkler of the present invention can be seen to be contained in housing 25 having base 14 which is sunken into the ground so that lid 30 having simulated grass 31 thereon is at the surface of the ground. At the upper end of housing 25 is enlarged portion 24 upon which lid 30 rests. Also at the upper end of housing 25 is chamber 17 which projects from the side of housing 25, as shown in cross-section in FIG. 7. Chamber 17 may be of any desired shape or size and serves to hold any compound or chemical 18, such as fertilizer, weed killer, an insecticide, or the like, which one desires to be applied to the ground around the sprinkler. Chamber 17 contains a passageway 19, shown in FIGS. 1–3*a* and FIG. 7, which permits water to flow from the interior of housing 25 and enlarged portion 24 into chamber 17 to dissolve or mix with the compound or chemical 18 contained therein. Alternatively, chamber 17 may be omitted as shown in FIG. 5, wherein the housing is labeled 25*a* to indicate the absence of passageway 19 and chamber 17.

The projectable lawn, farm and orchard sprinkler is thus completely enclosed in a water-tight assembly defined by base 14, housing 25, and enlarged portion 24, and in one embodiment, chamber 17. Water, or any other liquid can only enter the sprinkler through the water supply source and around the edges of lid 30.

As seen in FIGS. 1–3*a*, located inside housing 25 is projectable float 20 which floats upward within housing 25. As can be seen in FIG. 4, projectable float 20 has a sprinkler head, indicated generally by the numeral 15, connected at the top 47 thereof. Preferably float 20 has notches 42 in the bottom thereof to decrease or eliminate any wobbling of float 20 as air flows out the bottom of float 20. In the embodiment shown in FIGS. 1, 2, 3, and 3*a*, the projectable float 20 is connected to a water supply pipe 40. Pipe 40 is a rigid pipe which is in turn rigidly connected to housing 25 and to a source for supplying water under pressure (not shown) by a hose or any other suitable connector. Projectable float 20 is generally cylindrical in shape (although other suitable shapes may be used) and contains a slot 21 having top 22 and bottom 23 in the side thereof, as can be seen in FIG. 6, through which pipe 40 extends. The bottom 23 of slot 21 strikes against pipe 40, as shown in FIG. 2, when float 20 is projected upward thereby limiting the height to which float 20 will extend.

An alternate way of limiting the height to which the float of FIGS. 1–3*a* will rise is shown in FIG. 5. In FIG. 5 a flexible hose 35*a* is attached to pipe 40*a* at the bottom 14 of housing 25*a*, pipe 40*a* being connected to a water supply (not shown) in the same manner as pipe 40. The upper end of hose 35*a* is secured to float 20*a* by clamp 36, connector 56, and coupling insert 55. The length of hose 35*a* limits the height of float 20*a*.

Returning now to FIGS. 1–4, water supply pipe 40 is connected through coupling 41 to connector 44, hose 35, connector 56, and coupling 50 which is rigidly connected to the top 47 of float 20. Hose 35 is secured to connectors 44 and 56 by clamps 36. Coupling 50 is rigidly attached to float 20 by any suitable means, such as gluing, welding, screwing, etc. Channel 51*a* in connector 56 is in alignment with channel 51 in coupling 50.

As can be seen in FIG. 4, coupling 50 has a hollow channel 51 therein through which water flows in an upward direction when water is supplied under pressure to sprinkler head 15. Connected at the top end of coupling 50 is coupling insert 55. Coupling insert 55 is generally cylindrical in shape and is preferably threadably connected to coupling 50, which is also generally cylindrical in shape. Coupling insert 55 may also be glued to coupling 50, or attached by any other suitable means.

At the upper end of coupling 50 is located rotating stem 45. Rotating stem 45 is a generally cylindrical pipe and has lip 46 on the lower end thereof which rests against coupling 50 to support rotating stem 45. When water is supplied under pressure to the sprinkler, rotating stem 45 turns and rotates within coupling insert 55 thereby allowing sprinkler nozzle 16 to cover a wide circular area with water. Rotating stem 45 is turned by the torque exerted thereon due to water being expelled from nozzle 16. As is well known in the art, nozzle 16 may be located at any desired angle sufficient to cause a torque to be exerted on rotating stem 45 when water is expelled from nozzle 16.

Immediately above lip 46 and between coupling 55 and lip 46 is friction washer 49 which is a fiber washer for reducing friction between lip 46 and coupling 55. Friction washer 49 may be omitted, if desired.

Located in rotating stem 45 is channel 71 which is in alignment with channel 51. At the upper end of channel 71 is located jet 70 which is a hollow opening through which water from channel 71 flows when water is supplied under pressure to sprinkler head 15. As the water flows through jet 70, as indicated by arrows 74, water is drawn or pumped through flexible tube 60 and through inlet 73, assuming the end of flexible tube 60 is beneath the liquid level within enlarged portion 24. If the liquid level is beneath the end of flexible tube 60, air will be drawn or pumped into flexible tube 60 and inlet 73, mixed with the water being forced through jet 70, and expelled through nozzle 16. In order to achieve such a pumping action it is necessary that jet 70 be smaller in diameter than the inside diameter of outlet 72 to which nozzle 16 is connected. Inlet 73 should be located substantially adjacent to jet 70, preferably so that the downstream end of jet 70 ends approximately on the centerline of inlet 73. Preferably the inside diameter of inlet 73 is smaller than the inside diameter of outlet 72, although the inside diameter of inlet 73 may be varied to achieve various pumping rates through flexible tube 60.

Also located in coupling 50 is outlet channel 52 having aligned therewith insert 53 to which is connected flexible tubing 61. Connected to the other end of flexible tubing 61 is a pump structure generally indicated by the numeral 69, shown in detail in FIG. 9 and in FIG. 4. At the upper end of pump 69 is located inlet 71*a* through which water flows in the direction indicated by the arrow.

At the lower end of channel 71*a* is located jet 70*a* which is a hollow opening through which water from channel 71*a* flows when water is supplied under pressure to sprinkler 15. As water flows through jet 70*a*, as indicated by arrows 74, air is drawn or pumped through flexible tube 60*a* and through inlet 73*a*, assuming the end of flexible tube 60*a* is above the liquid level within enlarged portion 24. If the liquid level is below the end of flexible tube 60*a*, air will be drawn or pumped into flexible tube 60*a* and inlet 73*a*, mixed with the water being forced through jet 70*a*, and expelled through outlet 72*a*, as indicated by lines 74 in FIGS. 4 and 9, and bubbles 74*a*. In order to achieve such a pumping action it is necessary that jet 70*a* be smaller in diameter than the inside diameter of outlet 72*a*. Inlet 73*a* should be located substantially adjacent to jet 70*a*, preferably so that the downstream end of jet 70*a* ends approximately on the centerline of inlet 73*a*. Preferably the inside diameter of inlet 73*a* is smaller than the inside diameter of outlet 72, although the inside diameter of inlet 73 may be varied to achieve various pumping rates through flexible tube 60*a*. The air and water drawn through tubes 60*a* and 61 enters the interior of float means 20 forcing float means 20 to float upwardly when the water level within housing 25 reaches a sufficient height relative to the air trapped within float 20.

To prevent air bubbles 74*a* entering float 20 through outlet 72*a* from bubbling out through the bottom of float 20 upwardly between float 20 and housing 25, a baffle 48 may be optionally attached to the interior wall of float 20 or 20*a*, as shown in FIGS. 1–3*a* and in FIGS. 5 and 5*a*. Baffle 48 is located directly below outlet 72*a* so that water and air being expelled from outlet 72*a* impinge forcefully upon baffle 48 thereby causing a large portion of the air bubbles to separate from the water stream in which they are entrapped. Since through the use of baffle 48 few or no air bubbles escape upwardly between float 20 and housing 25, or float 20*a* and housing 25*a*, more air is trapped in floats 20 and 20*a*, and they therefore rise much more rapidly. Baffle 48 is rigidly connected to the inner wall of float 20 and 20*a*, and preferably has a slightly concave upper surface upon which the water expelled from outlet 72*a* impinges.

In the embodiment shown in FIG. 5 it is necessary to provide a means for preventing float 20*a* from rotating within housing 25*a* since there is no slot 21 in float 20*a*. To prevent float 20*a* from rotating within housing 25*a* there is a track 27 shown in FIGS. 5 and 5*a* and in FIG. 8 rigidly affixed to the interior wall of housing 25*a* which is slideably received within guides 26 located on the exterior of float 20*a*.

Also shown in FIG. 5 is a flexible drain hose 37 which has a bottom end 38 located at the bottom of housing 25*a* and a top end 39 located in enlarged portion 24. The purpose of flexible drain hose 37 is to provide a means for removing substantially all of the water in the bottom of housing 25*a*. Although water remaining in housing 25*a* will not damage the sprinkler even when frozen, one may nevertheless desire to remove sunstantially all of the water from the sprinkler when the sprinkler is not to be used for several months or longer. To remove water from housing 25*a*, flexible tube 60 is removed from air inlet 73 (shown in FIG. 4) and the upper end 39 of flexible drain hose 37 is placed over inlet 73. When water pressure is supplied to the sprinkler, water in housing 25*a* will be pumped through flexible drain hose 37 and out nozzle 16 in the same manner in which water from enlarged portion 24 was removed by flexible tube 60. Flexible drain hose 37 should be at least as large in inside diameter as the inside diameter of flexible tube 60 to insure an adequate rate of removal of water. A drain hose such as flexible drain hose 37 may be added to any of the embodiments shown in FIGS. 1–11, or the hose may be omitted.

Other suitable means known in the art may be used to prevent rotation of float 20*a* within housing 25*a*. For example, both housing 25*a* and float 20*a* could be elliptical in cross-section.

Both of the embodiments shown in FIGS. 1–4 and in FIG. 5 operate in the following manner:

A. Empty or Partly Filled Start

In FIG. 1 and FIG. 5 sprinkler housings 25 and 25*a* are empty and contain no water. When water is supplied under pressure to pipes 40 or 40*a*, water flows upwardly through tube 35 or 35*a*, through channel 51*a*, channel 51, channel 52, flexible tube 61, inlet 71*a*, jet 70*a*, and is expelled through outlet 72*a*. As explained previously, air is drawn in through flexible tube 60*a*, inlet 73*a*, mixed with water in outlet 72*a*, and is expelled outwardly through outlet 72*a*. Water expelled from outlet 72*a* thus begins filling the interior of housing 25 or 25*a*, which serve as reservoirs for the water. Water also travels from channel 51 through channel 71, jet 70, outlet 72, and is expelled through nozzle 16. Air drawn through tube 60 and inlet 73 is mixed with water in outlet 72 and expelled with the water through nozzle 16. The water expelled through nozzle 16 is deflected by lid 31 and enlarged portion 24 down between float 20 and housing 25, or float 20*a* and housing 25*a*, to fill the interior of housing 25 or 25*a*. As the water level within housing 25 or 25*a* rises above the top of notches 42, air is trapped in the interior of float 20 of 20*a* and the pressure of the air trapped therein increases as the level of water rises within housing 25 or 25*a*.

The density of the materials from which sprinkler head 15 and float 20 or 20*a* are constructed and the inside diameter of float 20 or 20*a* are selected so that at some point float 20 or 20*a* begins to float upwardly projecting sprinkler head 15 above the surface of the ground, as indicated in FIG. 2. Float 20 stops rising when pipe 40 contacts the bottom 23 of slot 21. Referring now to FIG. 5, float 20*a* stops rising when stop 28 located on the exterior of float 20*a* strikes stop 29 or when hose 35*a* is fully extended, whichever occurs first. The stops 28 and 29 may be omitted, thereby limiting the height to which float 20*a* rises by the length of hose 35*a* alone. Stop 29 is connected to the interior of housing 25*a* and is aligned vertically above stop 28.

As the water level rises within housing 25 or 25*a*, as indicated in FIG. 2, it will at some point reach the bottom end of flexible tube 60. At such point, flexible tube 60 will begin to pump liquid from the interior of enlarged portion 24 through inlet 73, outlet 72 and out nozzle 16, mixing the liquid contained in enlarged portion 24 with water flowing through jet 70. It is necessary that the length of tube 60 and the height to which projectable float 20 or 20*a* rises be selected so that the bottom end of tube 60 remains inside upper portion 24 when projectable float 20 or 20*a* is fully projected to its maximum height to prevent liquids from overflowing out of upper portion 24 onto the ground and to pump chemicals into nozzle 16. To prevent water from completely filling enlarged portion 24 and overflowing, the inside diameters of flexible tube 60, inlet 73, jet 70, outlet 72, channel 53, flexible tube 61, inlet 71*a*, jet 70*a*, and outlet 72*a* are selected so that water being extracted or pumped from housing 25 or 25*a* is extracted more rapidly than water is being added to housing 25 through outlet 72*a*.

B. Filled Start

Figure 3A:
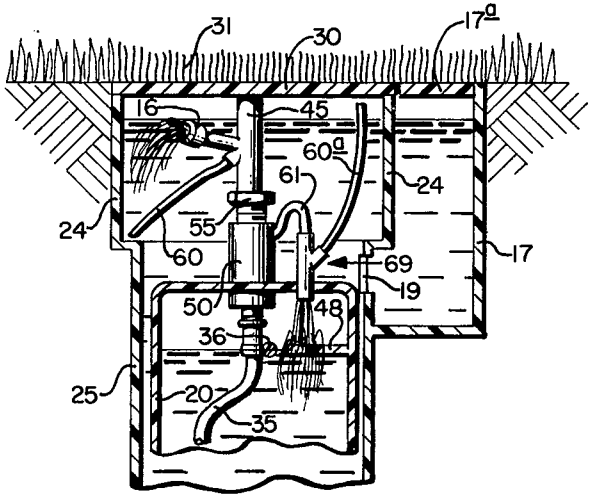
FIG. 3 is a partly sectional side view of a projectable sprinkler in a submerged position filled with liquid.
Figure 3:
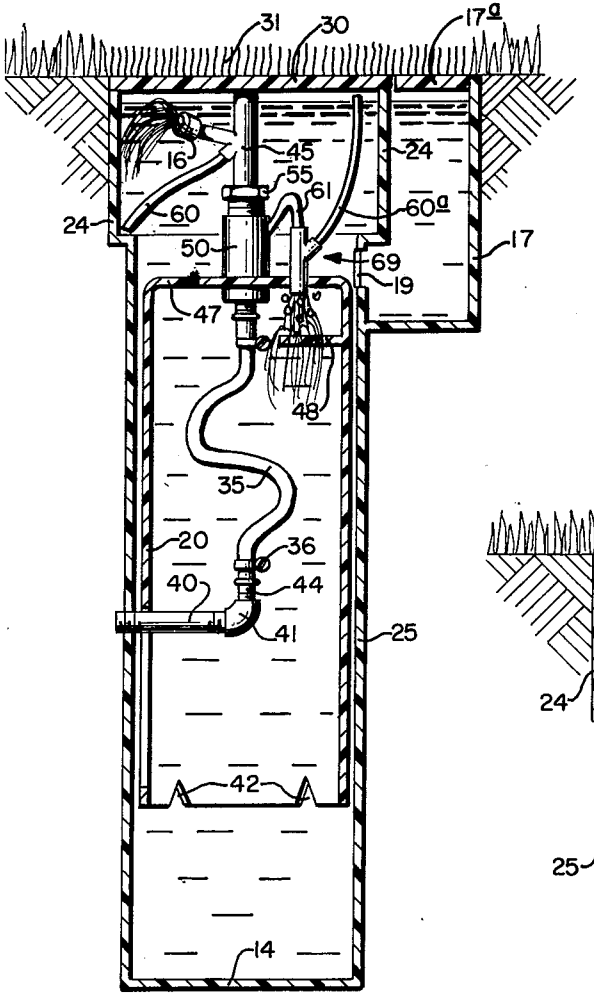

In FIG. 3, housing 25 is shown to be filled with water. When water is supplied under pressure to pipe 40, flow occurs as explained above for an empty or partly filled start with the exception that lines 60 and 60*a* are beneath the surface of the water momentarily. However, the upward force applied to sprinkler head 15 by the water pressure supplied to sprinkler head 15 causes the sprinkler head to rise slightly allowing some small amount of air to enter enlarged portion 24. In addition, water being expelled from nozzle 16 splashes outwardly around the edge of lid 30 forcing some water within enlarged portion 24 out of enlarged portion 24 and onto the surface of the ground surrounding the sprinkler, thereby permitting more air to enter enlarged portion 24. As can be seen in FIG. 3*a*, the water level within enlarged portion 24 need only drop slightly for the end of line 60*a* to rise above the water level within portion 24. As soon as the end of line 60*a* rises above the water level within enlarged portion 24, air will begin to enter or be pumped into the interior of float 20, as indicated in FIG. 3*a* and as explained previously. Once air begins to enter the interior of float 20 or 20*a* the float will rise as explained above in the explanation of the Empty or Partly Filled Start.

One of the advantages of the sprinkler head 15 of the present invention is illustrated in FIG. 10. Conventional heads cover an area indicated by arrow *a* with water. The area between the sprinkler and the beginning of arrow *a* is covered only very lightly with water. Therefore, as the sprinkler head turns, the wetted area is in the shape of a doughnut. The length from the sprinkler to the outside portion of arrow *a* is commonly about 40 feet and the length indicated by arrow *a* is commonly about 8 feet. However, employing the sprinkler head of the present invention on any conventional projectable stationary sprinkler, an additional area *b* is covered in addition to that of area *a*. Area *b* is approximately equal to that of area *a* and therefore, in accordance with the present invention, approximately 16 feet would by densely covered with water from the sprinkler thereby representing approximately 50% increase in the area covered making the sprinkler approximately 50% more effective. It is believed this additional area is covered because the air drawn in through inlet 73 or 73*a* is mixed with water flowing out of outlet 72 or 72*a* thereby causing the water to disperse somewhat rather than coming out in a coherent stream or jet.

In FIG. 11 is shown a conventional impact or oscillating sprinkler head, indicated generally by the arrow 80, which has been modified in accordance with the present invention. Sprinkler 80 is disclosed in U.S. Pat. No. 3,309,025 issued Mar. 14, 1967 to Malcolm, which is hereby incorporated by reference. FIG. 11 is partly cut away to show how the internal portions of the sprinkler head of the prior art are modified to make the sprinkler perform in accordance with the present invention. The remaining elements of the sprinkler operate in the manner explained in U.S. Pat. No. 3,309,025. The elements labeled 49*b*, 50*b*, 51*b*, 52*b*, 53*b*, 55*b*, 60*b*, 61*b*, 70*b*, 71*b*, 72*b*, and 73*b* perform identically to the corresponding elements 49, 50, 51, 52, 53, 55, 60, 61, 70, 71, 72, and 73, respectively, which have been explained previously. Hose 61*b* can be attached to air pump means 69. Thus sprinkler head 80 of FIG. 11 may be substituted for sprinkler head 15.

In FIG. 12 is shown another embodiment of the present invention in which the sprinkler head 15 is mounted on the surface of the ground in a stationary position. Sprinkler head 15 can be seen to be mounted in a reservoir or bowl 75 having fluid 82 therein. All of the elements of sprinkler head 15 shown in FIG. 12, that is elements 16, 45, 50*b*, 53*b*, 55, 60, and 61, perform in the same manner as previously explained, except that insert 53*b* (which is shown in greater detail in FIG. 11) is not connected to air pump means 69 as was 63 but instead sprays water in bowl 75. Insert 53*b* may be replaced by a mere hole in the side of coupling 50*b* to allow water to enter bowl 75. Bowl 75 sits on legs 76. Fertilizer or any other chemical may be placed in the bottom of bowl 75. Water pressure is supplied to the head through hose 77. Water enters bowl 75 through insert 53*b* to dissolve the fertilizer and fill the bowl with water. As soon as the water level within bowl 75 reaches the bottom of hose 60 the solution will begin to be sucked through hose 60, as previously mentioned in the explanation of FIG. 4, and sprayed out nozzle 16.

Lid 78 attached to the top of sprinkler head 15 by bolt 81 is another important embodiment of the present invention which increases the area wetted by a sprinkler head and may be used with the sprinkler heads 15 and 80 of the present invention. or with any other conventional stationary or rotating sprinkler. Sprinkler lid 78 has a flap 79 thereon attached to the sprinkler lid 78 by a flexible hinge 84. Lid 78 rotates with rotating stem 45. Flap 79 is positioned over nozzle 16 so that the water spraying from nozzle 16 impinges upon the bottom of flap 79. Flap 79 moves upward slightly but hinge 84 is sufficiently stiff to maintain some downward force on the water exiting from nozzle 16. Hinge 84 can be made from any suitable stiff, flexible material such as rubber and plastic tapes, synthetic fabrics, and the like, which will allow some upward motion of flap 79 when water impinges thereon, but will not allow flap 79 to reach a completely vertical position relative to the ground. For example, the angle between flap 79 and lid 78 may vary from about 0° to about 90° or more preferably, from about 30° to about 60° when water is impinging thereon. As a result of this downward pressure, a greater distribution of water is realized, as illustrated in FIG. 10 by arrow *c*. Without flap 79 the sprinkler head of the present invention would cover area *a* and *b*. With flap 79 additional area *c* is covered thoroughly with water so that areas *a*, *b*, and *c* are all covered with water. Thus the area covered with sprinkler lid 78 is approximately four or five times greater than the area covered by the rotating sprinklers of the prior art, and is roughly twice as great as the area covered by the sprinkler heads of the present invention when used without the sprinkler lid 78.

In FIG. 13 is shown an additional embodiment of the present invention in which the sprinkler head 15, or head 80, if desired, is mounted on the surface of the ground in a stationary position. As can be seen in FIG. 13, the sprinkler head 15 is mounted on cylindrical housing 25*b*, somewhat similar to housing 25 and 25*a* which is held in a vertical position by legs 92 on the surface of the ground. The bottom of housing 25*b* is closed by base 14. A horizontal water supply pipe 87 is located near the bottom of housing 25*b* and is connected to water pipe 86 which is in turn connected to coupling 50*c*. Coupling 50*c* is identical to coupling 50 previously described in the explanation of FIGS. 1–4, with the exception that coupling 50*c* contains no channel 52 or insert 53, and therefore all water entering coupling 50*c* continues upward to coupling insert 55 and does not exit through channel 52 and insert 53 as it does in the embodiment of FIG. 4. The remaining portions, both internal and external, of the sprinkler head 15 are identical to those described in FIG. 4, the corresponding parts shown in FIG. 13 being rotating stem 45, outlet 72, nozzle 16, hose 60 and inlet 73. The lid 78 is identical to the lid 78 described in FIG. 12, although other conventional tops such as top 30 shown in FIG. 4 may be used or lid 78 may be completely omitted. Housing 25*b* differs from housing 25 and 25*a* in that it contains an upper bowl 95 defined by the walls of cylindrical housing 25*b* and upper bowl bottom 96. Upper bowl bottom 96 contains coupling 50*c* in addition to a hole therein into which plug 85 is inserted. Upper bowl bottom 96 also has connected thereto tube 91 which is any conventional hollow tube or pipe which extends through upper bowl bottom 96 and downward into the bottom of housing 25*b*.

The embodiment of FIG. 13 operates in the following manner. Before water is supplied to the sprinkler, plug 85 can be removed and fertilizer, weed killer, or any other desired chemical in liquid or solid form may be poured into the interior of housing 25*b* through the hole in which plug 85 is inserted. After pouring the chemical into the interior of housing 25*b* plug 85 is inserted in the hole to form an air-tight seal. Water is then supplied to the sprinkler through horizontal water supply 87 which is connected to a water hose or any other similar water supply source. Water flows as indicated by the arrows in the horizontal water supply pipe 87 upward through vertical water supply pipe 86. Vertical water supply pipe 86 has a hole 90 therein which allows some water to spray into the interior of upper housing 25*b*, as indicated in FIG. 13. Water spraying from hole 90 into the interior of upper housing 25*b* mixes with the fertilizer or other chemical contained therein dissolving and/or diluting the chemical. The water level rises to some point as indicated in FIG. 13. Water continues upward through vertical water supply pipe 86, through coupling 50*c*, coupling insert 55, rotating stem 45, outlet 72, and is sprayed outward through nozzle 16. Initially, air will be drawn upwards through flexible hose 60 and outward through outlet 72 and nozzle 16, as previously explained in the explanation of FIG. 4. At some point the water level within housing 25*b* will rise sufficiently high to cover the lower end of vertical tube 91 thereby forming an air-tight chamber 88 between the top of the water level and the bottom of upper bowl bottom 96. As the liquid level in housing 25*b* rises, the pressure on the air within chamber 88 increases to a point at which the liquid is forced upward through pipe 91 into upper bowl 95. As the level of the solution within upper bowl 95 rises it will eventually reach flexible tube 60 and will be drawn upward into tube 60 and outward through outlet 72 and nozzle 16, as previously described in the explanation of FIG. 4. Thus, chemicals placed in the interior of housing 25*b* are forced upward through tube 91 and outward through outlet 72 and nozzle 16 onto the area surrounding the sprinkler.

The sprinkler embodiment of FIG. 13 will not allow the chemical within the sprinkler to spill immediately on the ground if the sprinkler is turned over, as would the embodiment of FIG. 12. The interior of the sprinkler may be made as large as desired to accommodate any amount of chemical for treatment of the yard. Of course, the sprinkler will also operate to sprinkle the lawn with water alone if no chemical is added.

In FIG. 14 is shown still another embodiment of the present invention in which the sprinkler head 15 is mounted on the surface of the ground 57 in a stationary position. As can be seen in FIG. 14, the sprinkler includes a cylindrical housing 25*b* identical to the housing of FIG. 13, and similar to housings 25 and 25*a*, which is held in a vertical position by legs 92 on the surface of the ground. The bottom of the housing is closed by base 14*a*. Horizontal water supply pipe 87 is located near the bottom of housing 25*b* and is connected to water pipe 86*a*, which is similar to water pipe 86 of FIG. 13 except that it has no hole 90 therein. Water pipe 86*a* is connected to coupling 50 which is shown in detail in FIG. 4. Sprinkler head 15 and air pump means 69 are shown in detail in FIG. 4, and have been explained above. Top 78 is shown in FIGS. 12 and 13 and has been explained above. Upper bowl 95 and tube 91 have been previously explained in the discussion of the embodiment of FIG. 13. Upper bowl bottom 96*a* differs from upper bowl bottom 96 of the embodiment of FIG. 13 in that air pump means 69 is inserted therein.

The sprinkler embodiment of FIG. 14 operates in the following manner. Before water is supplied to the sprinkler, plug 85 can be removed and fertilizer, weed killer, chemical in liquid or solid form, or the like, may be poured into the interior of housing 25*b* through the hole in which plug 85 is inserted. After pouring the chemical into the interior of housing 25*b*, plug 85 is inserted into the hole to form an air-tight seal. Water is then supplied to the sprinkler through horizontal water supply 87 which is connected to a water hose or any other similar water supply source. Water flows as indicated by the arrows in the horizontal water supply pipe 87 upward through vertical water supply pipe 68*a*. Sprinkler head 15 and air pump means 69 operate as previously explained in the description of the embodiment of FIGS. 1–4 and in the description of FIG. 9. Thus, water and air are introduced into the interior of housing 25*b*. At some point the water level within housing 25*b* will rise sufficiently high to cover the lower end of vertical tube 91 thereby forming an air-tight chamber 88 between the top of the water level and the bottom of upper bowl 96. The air pressure will increase due to the air being pumped through air pump means 69 so that the water level will be maintained at the lower end of tube 91. The pressure exerted by the air will at some point force the liquid in housing 25*b* upward through tube 91 into upper bowl 95 from which it will be pumped, as previously explained, by flexible tube 60 out through nozzle 16.

If housing 25*b* is completely filled with a solution of chemical and water or with water alone, air being pumped through air pump means 69 will eventually force the level of the water down to the bottom of tube 91 thereby indicating, assuming that housing 25*b* is made of a translucent or transparent material, when substantially all of the chemical has been applied to the yard or ground around the sprinkler. In addition, the only fluid level left within housing 25*b* will be that fluid lying below the lower end of tube 91 and the base 14 of the sprinkler.

The angle of the nozzle of sprinkler head 15 or 80 in general with the horizontal may be adjusted to sprinkle objects at various heights. For instance, the nozzle can be tilted upward at a steep angle to spray various chemicals or solutions on fruit trees, pecan trees, or other tall plants on farms and orchards, or the like, to prevent insects from harming the trees or to prevent the trees from contracting various plant diseases. In addition, if the sprinkler head of the present invention were used on a stationary stand and the coupling such as 50*c* shown in FIG. 13 were used (which has no channel 52 therein), the line 60 could be extended into a tub or other reservoir containing a chemical or other solution which one may desire to spray upon the area surrounding the sprinkler.

The various components of the present invention can be constructed from any material desired, such as metals, plastics, and the like, although plastics are preferred because of their generally lower cost. Some parts which have been shown as two elements may be molded from a single piece of plastic, if desired.

It should be understood that air pump means 69 could be replaced with a funnel having its neck or base inserted into the interior of float 20, 20*a*, or bottom 96*a*. Water would flow through tube 61 down into the top of the funnel forcing air and water into the interior of housing 25. However, air pump means 69 is preferred.

Having fully described the present invention, it is desired that it be limited only within the spirit and scope of the following claims.

What is claimed is:

1. A lawn, farm and orchard sprinkler comprising:

A. housing means having top means and bottom means, said housing means having bowl means connected to the top thereof for containing liquids or solids;

B. sprinkler head means connected to said top means for spraying fluids, said sprinkler head means comprising:

i. nozzle means for spraying fluids;

ii. liquid supply means connected to said nozzle means for supplying a stream of liquids under pressure to said nozzle means, said liquid supply means having hole means therein for supplying liquid to the interior of said housing means, and iii. pump means connected to said nozzle means for pumping fluids from said bowl means into said nozzle means;

C. tube means connected to said top means for conveying fluids from said interior of said housing means to the interior of said bowl means, and D. hole means in said top means for introducing liquids or solids into the interior of said housing means.

2. The sprinkler of claim 1 wherein said housing means is generally cylindrical in shape and hollow inside.

3. The sprinkler of claim 1 wherein said nozzle means rotate.

4. The sprinkler of claim 1 wherein said sprinkler has means connected thereto for increasing the area wetted by said sprinkler comprising lid means connected to said sprinkler head means, said lid means having flap means therein upon which fluids sprayed from said sprinkler head impinge.

5. The sprinkler of claim 1 wherein said first pump means comprises:

i. first inlet means for conveying fluids from said bowl means to said stream of liquids, and ii. jet forming means including a reduced section means located in the downstream end of said hollow channel means and substantially adjacent to the intersection of said first inlet means and said stream of liquids for increasing the velocity of said stream of liquids as said stream of liquids exits from said channel means into said nozzle means, said reduced section means having an inside diameter smaller than the inside diameter of said channel means.

6. The sprinkler head of claim 5 wherein said reduced section means lies approximately on the centerline of said inlet means.

7. The sprinkler head of claim 5 wherein said inlet means has an inside diameter smaller than the inside diameter of said nozzle means.

8. The sprinkler of claim 5 wherein said first inlet means has tube means connected thereto for conveying fluids contained in said bowl means to said first inlet means.

9. The sprinkler of claim 8 wherein said tube means has two ends, one end of said tube means being connected to said first inlet means, the other end of said tube means terminating in said bowl means.

10. A lawn, farm, and orchard sprinkler comprising:

A. housing means having top means and bottom means, i. said housing means being generally hollow inside, ii. said housing means having bowl means connected to the top thereof for containing liquids or solids;

B. sprinkler head means connected to said top means for spraying fluids, said sprinkler head means comprising:

i. rotary nozzle means for spraying fluids;

ii. liquid supply means connected to said rotary nozzle means for supplying a stream of liquids under pressure to said rotary nozzle means, said liquid supply means having hole means therein for supplying liquid to the interior of said housing means;

iii. pump means connected to said rotary nozzle means for pumping fluids from said bowl means into said rotary nozzle means, said pump means comprising:

a. first inlet means for conveying fluids from said bowl means to said stream of liquids, and b. jet forming means including a reduced section means located in the downstream end of said hollow channel means and substantially adjacent to the intersection of said first inlet means and said stream of liquids for increasing the velocity of said stream of liquids as said stream of liquids exits from said channel means into said nozzle means, said reduced section means having an inside diameter smaller than the inside diameter of said channel means.

c. tube means connected to said top means for conveying fluids from said interior of said housing means to the interior of said bowl means, and d. hole means in said top means for introducing liquids or solids into the interior of said housing means.

11. The sprinkler of claim 10 wherein said first inlet means has tube means connected thereto for conveying fluids contained in said bowl means to said first inlet means.

12. The sprinkler of claim 11 wherein said tube means has two ends, one end of said tube means being connected to said first inlet means, the other end of said tube means terminating in said bowl means.

13. The sprinkler of claim 10 wherein said sprinkler has means connected thereto for increasing the area wetted by said sprinkler comprising lid means connected to said sprinkler head means, said lid means having flap means therein upon which fluids sprayed from said sprinkler head impinge.

* * * * *